US005310376A

United States Patent [19]

Mayuzumi et al.

[11] Patent Number: 5,310,376

[45] Date of Patent: May 10, 1994

[54] TOY THAT CAN BE ASSEMBLED INDEPENDENTLY BY A CHILD

[75] Inventors: Masaki Mayuzumi; Jun Kawahara; Tatsuo Nakamata, all of Tokyo, Japan

[73] Assignee: Combi Corporation, Tokyo, Japan

[21] Appl. No.: 47,363

[22] Filed: Apr. 19, 1993

Related U.S. Application Data

[63] Continuation of Ser. No. 812,988, Dec. 24, 1991, abandoned.

[30] Foreign Application Priority Data

Feb. 7, 1991 [JP] Japan ..... 3-4580[U]
May 15, 1991 [JP] Japan ..... 3-43358[U]

[51] Int. Cl.[5] ..... A63H 33/08

[52] U.S. Cl. ..... 446/107; 446/95; 446/126; 446/118

[58] Field of Search ..... 446/107, 124, 374, 126, 446/99, 118, 95; 434/278, 279, 281

[56] References Cited

U.S. PATENT DOCUMENTS

| | | | |
|---|---|---|---|
| 2,219,130 | 10/1940 | Herrmann | 446/374 X |
| 2,810,233 | 10/1957 | Jakobsen | 446/126 |
| 3,176,428 | 4/1965 | Slingluff | 446/107 |
| 3,333,349 | 8/1967 | Brumlik | 446/126 X |
| 3,458.949 | 8/1969 | Young | 434/278 X |
| 3,918,196 | 11/1975 | Schleich | 446/107 |
| 3,939,581 | 2/1976 | Clarke, Jr. | 434/278 |
| 3,987,579 | 10/1976 | Palenik, III | 446/118 |
| 4,078,328 | 3/1978 | Rayment | 446/126 |
| 4,244,140 | 1/1981 | Kim . | |
| 4,547,160 | 10/1985 | Labelle | 446/103 X |

FOREIGN PATENT DOCUMENTS 93989 1/1897 Fed. Rep. of Germany .

*Primary Examiner*—Mickey Yu
*Attorney, Agent, or Firm*—Sughrue, Mion, Zinn Macpeak & Seas

[57] ABSTRACT

A toy that can be assembled by a child. At least one first block element consisting of a rod made of a flexible material including a fitting terminal at one end or opposite ends thereof is provided. The fitting terminal has at least one fitting projection thereon. A second block element has a plurality of fitting holes each adapted to be fitted onto one of the fitting projections. The first block element and the second block element are combined with each other during an assembling operation so as to exhibit a desired three dimensional configuration. Each fitting terminal is provided with a plurality of fitting projections projecting from the outer surface of the fitting terminal so that the fitting projections can be selectively fitted into one of the fitting holes on the second block element. The rod constituting the first block element is composed of a plastically deformable core and a flexible sheath molded of a soft synthetic resin surrounding the core. The sheath is integrated with the core to form an integral structure. The core is composed of a wire-type material having shape memory characteristics.

6 Claims, 4 Drawing Sheets

TOY THAT CAN BE ASSEMBLED INDEPENDENTLY BY A CHILD

This is a continuation of application No. 07/812,988 filed Dec. 24, 1991, abandoned.

BACKGROUND OF THE INVENTION

1. Field of the Invention

The present invention relates generally to a toy that can be assembled by a child independently. In particular, the present invention is a toy having a predetermined structure which can be assembled by the child by combining a plurality of structural elements, each designed in a block-shaped configuration with each other.

2. Description of the Related Art

A toy of the foregoing type, assembled to provide a predetermined structure or exhibit a predetermined configuration by combining a plurality of block elements with each other, is conventionally known. In such a toy, block elements are used to form or build a toy. Fitting projections, and fitting holes to be fitted onto the fitting projections, designed so as to conform with a common standard, are formed at predetermined positions of each block element. When the toy is assembled by a child, fitting projections on one block element are fitted into fitting holes formed on other block elements.

Since the conventional toy is assembled by using block elements each having a predetermined rigid configuration which cannot be changed during an assembling operation, the elements cannot be plastically deformed so as to assume a desired configuration.

For this reason, the appearance of the assembled toy and a sensory perception derived therefrom are very hard or rigid. Consequently, with such a conventional toy, that a soft flexible feeling cannot be obtained from the toy after assembly of the toy is completed.

In addition, since a hard material which cannot plastically be deformed is employed as a raw material for all the block elements to be used for a toy, and a specific configuration-is imparted to the material, block elements cannot be joined to each other using other block elements which are dimensioned to have a small diameter like a string or cord.

SUMMARY OF THE INVENTION

The present invention has been made with the foregoing limitations of conventional toys in mind.

Accordingly, an object of the present invention is to provide a toy that can be assembled independently by a child having a simple structure and a configuration that can be freely plastically deformed during an assembling operation.

Another object of the present invention is to provide a toy that can be changed and subsequently assembled by a child having an original shape that can be restored after the child is finished playing with it.

Another object of the present invention is to provide a toy that can be assembled by a child that has plastically deformable block elements that are highly superior in safety, and which can be repeatedly plastically deformed with little resulting plastic fatigue.

According to the present invention, there is provided a toy having at least one block element consisting of a rod made of a flexible material and having a predetermined length. This block element has a fitting terminal at one end or opposite ends thereof. The fitting terminal has at least one fitting projection projecting therefrom. A second block element has a plurality of fitting holes, each to be fitted onto the fitting projection formed at predetermined positions on the first block element. The block elements are combined with each other during an assembling operation so as to exhibit a desired three-dimensional configuration.

In general, each fitting terminal is provided with a plurality of fitting projections projecting from the surface of a fitting terminal on the first block element in a spaced relationship so that one of the fitting projections is fitted into one of the fitting holes on the second block element. The rod constituting the first block element is composed of a plastically deformable core arranged at the central part of the rod, and extending along the center line thereof, and a flexible sheath molded of a soft synthetic resin, or the like, surrounding the core. The sheath is combined with the core to form an integral structure. The core is composed of a wire-shaped material made of a raw material selected from a shape memory alloy and a shape memory synthetic resin having plastic properties.

Usually, the second block element comprises a plate-shaped base element on which a plurality of fitting holes are formed. However, the second block element may comprise a column-shaped base element on which a plurality of fitting holes are formed. Alternatively, the second block element may comprise a spherical, or other shape, base element on which a plurality of fitting holes are formed.

Other objects, features and advantages of the present invention will become apparent from reading of the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENTS

The present invention will now be described in detail with reference to the accompanying drawings which illustrate preferred embodiments of the present invention.

A toy in accordance with the present invention is illustrated in FIGS. 1–6 and is essentially composed of block element a consisting of flexible rod 1 including fitting terminals 2 at one end, or opposite ends, thereof and block element b having a number of fitting holes 3 formed at predetermined positions thereon so as to allow fitting terminal 2 to be fitted into one of fitting holes 3.

Figure 1:
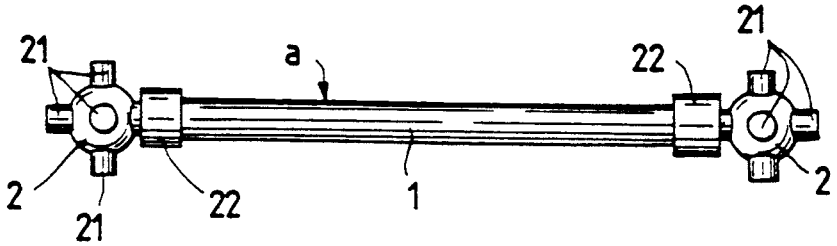
FIG. 1 is a front view of a block element comprising a flexible rod in accordance with the present invention.
Figure 2:
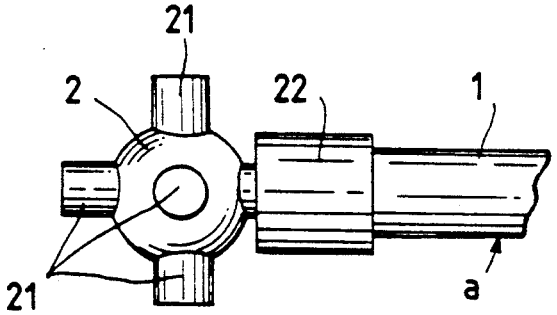
FIG. 2 is an enlarged fragmentary front view of the block element in FIG. 1, particularly illustrating a plurality of fitting projections projecting from one end of the flexible rod.

As shown in FIG. 1, block element a consisting of flexible rod 1 including fitting terminals 2 at one end, or opposite ends, thereof has a plastically deformable core 11 is arranged at the central part of the flexible rod 1 while extending along the longitudinal axis thereof. Also, flexible soft sheath 12, molded of a soft synthetic resin, is formed integral with the core 11 while surrounding the same. A fundamental property of block element a is that a plastically deformable metallic wire having flexibility, such as aluminum wire or the like, is used as a raw material employable for core 11.

Figure 3:
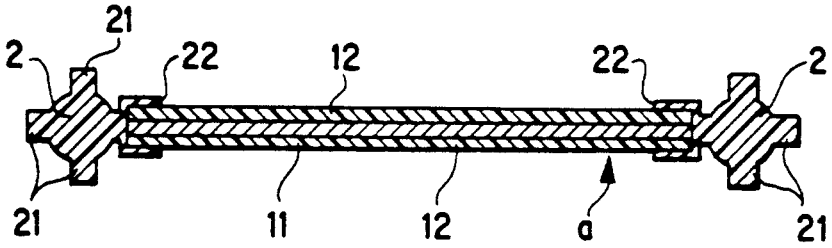
FIG. 3 is a sectional view of the block element in FIG. 1.

In view of the fact that the flexible rod 1 is frequently subjected to bending or folding during usage, it is most preferable that a thickness of sheath 12 is equal to or slightly more than a diameter of the core 11, as shown in FIG. 3. Please note that FIGS. 1–6 are not intended to be to scale.

Alternatively, flexible rod 1 may be constructed such that core 11 is not made integral with sheath 12. In such a case, core 11, being a flexible metallic wire, may be inserted through the interior of a cylindrical member molded of a soft synthetic resin. In this case, since the core 11 loosely extends through the cylindrical sheath 12, any adhesive contact between core 11 and cylindrical sheath 12 is minimal. For this reason, this construction is not as desirable as an integral construction of flexible rod 1.

If flexible rod 1 is, for some unavoidable reason, constructed in the above-identified non-integral manner, flexible rod 1 may be somewhat weakened due to plastic fatigue within a comparatively short period of time. This is so because only core 11 is bent and sheath 12 does not add strength thereto.

It should be noted that the material used for core 11 should not be limited only to metallic wire, such as an aluminum wire or the like, but, on the contrary, any kind of material can freely be selected as a raw material for core 11, provided that it is flexible and plastically deformable. For example, a wire material composed of a shape memory alloy having such a nature that its original shape is restored by heating or a wire material molded of a shape memory synthetic resin, having the same characteristics, can be employed as a raw material for core 11.

In a case where a shape memory material of the foregoing type is used, the original shape can easily be restored without plastic fatigue of core 11, by allowing an adult to heat rod 1, which has been deformed, after a child is finished playing with the toy, provided that a linear configuration is previously memorized in the shape memory material.

Fitting terminals 2 disposed at one end, or opposite ends of flexible rod 1 are molded of a hard synthetic resin, or the like, and a plurality of fitting projections 21, each to be fitted into one of fitting holes 3 on block element b, are projected from the outer peripheral surface of each fitting terminal 2. In order to form an integral structure with flexible rod 1, fitting portion 22 projecting from each fitting terminal 2 is firmly fitted onto one end of flexible rod 1.

It should be noted that any suitable structure may be employed for integrating fitting terminal 2 with flexible rod 1, provided that it is assured that fitting terminal 2 can firmly be integrated with the flexible rod 1. For example, a press fit or adhesive may be utilized.

A manner of projecting fitting projections 21 from each fitting terminal 2 can be selected freely. For example, a plurality of fitting projections 21 may project from the outer peripheral surface of each spherical fitting terminal 2 in spaced relationship in such a manner illustrated in the drawings. Alternatively, a single fitting projection 21 may project from the outer spherical surface of a ball-shaped fitting terminal (not shown).

Figures 4, 4A:
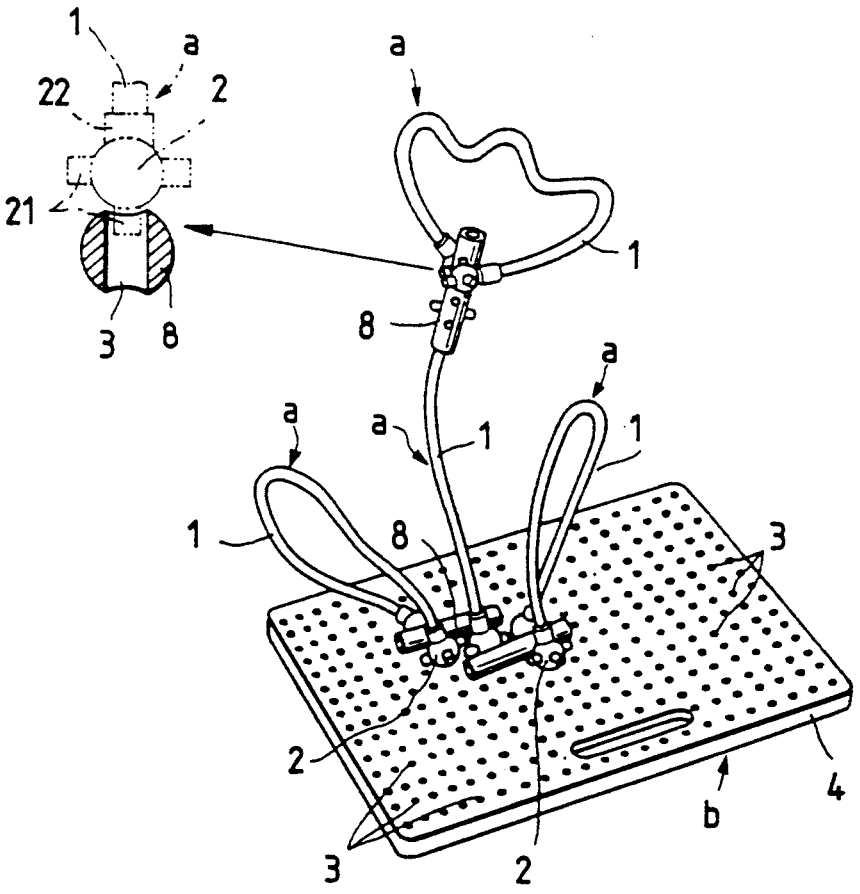
FIG. 4 is a perspective view of a toy in accordance with a first embodiment of the present invention.
FIG. 4A is an enlarged sectional view of a portion of FIG. 4.
Figure 5:
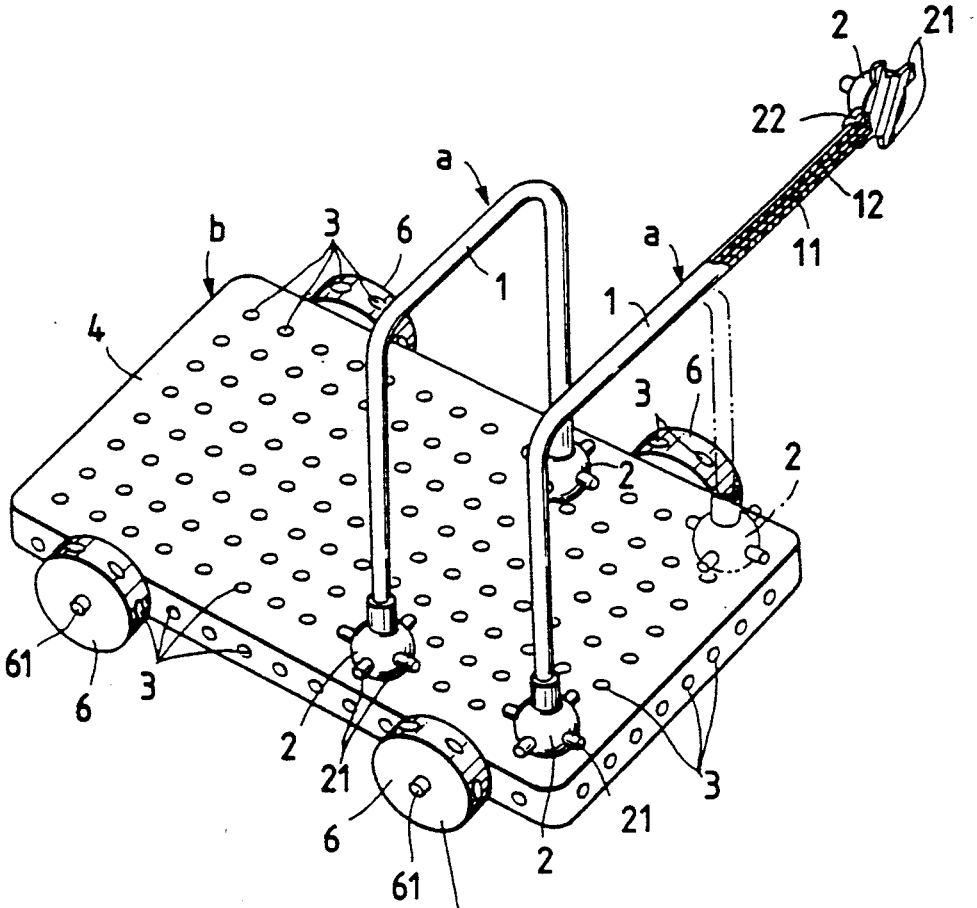
FIG. 5 is a perspective view of a toy in accordance with a second embodiment of the present invention.
Figure 5A:
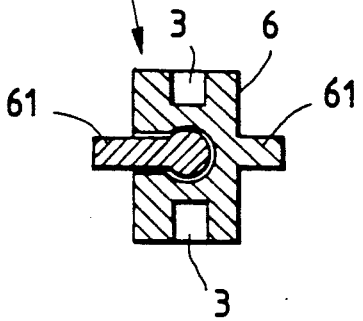
FIG. 5A is an enlarged sectional view of a portion of FIG. 5.
Figure 6A:
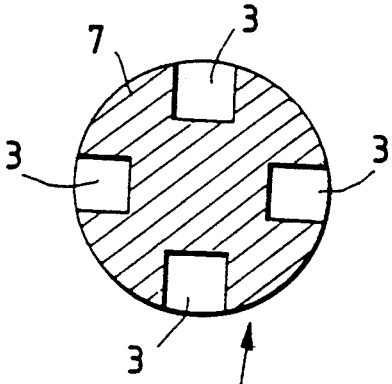
FIG. 6A is an enlarged sectional view of a portion of FIG. 6.
Figure 6B:
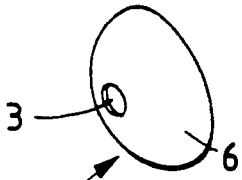
FIG. 6B is an enlarged sectional view of a portion of FIG. 6.
Figure 6:
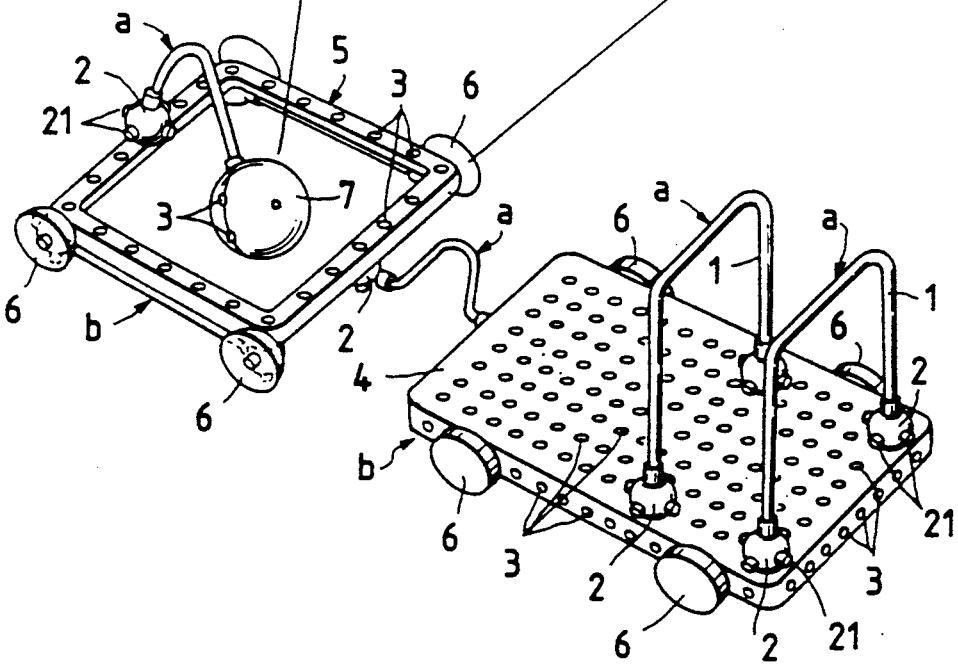
FIG. 6 is a perspective view of a toy according to a third embodiment of the present invention.

Hard block element b to be combined with the block element a extensively known as a conventional block element for a toy to be assembled by a child. As illustrated in FIGS. 4–6, hard block element b is constructed such that a number of fitting holes 3 to be fitted onto one of fitting projections 21 are formed on the upper surface and side surfaces of a base element 5, such as a square frame-shaped base plate, or the like. As illustrated in FIG. 5, hard block element b may be constructed such that fitting projection 61, projecting from the central part of circular disc-shaped element 6 having a predetermined diameter, is fitted into one of fitting holes 3 formed on plate-shaped base element 4 or frame-shaped base element 5 (see FIG. 6) so as to attach wheels to the toy. Otherwise, as illustrated in FIG. 6, hard block element b may be constructed in the form of spherical base element 7 around which a plurality of fitting holes 3 are formed in spaced relationship. In addition, as illustrated in FIG. 4, hard block element b may be constructed in the form of column-shaped element 8 having a predetermined length around which a plurality of fitting holes 3 are formed.

Practical use of the toy of the present invention will be described below.

FIG. 4 illustrates a case where a plurality of block elements a are used so as to exhibit a configuration similar to a flower arrangement. In this case, each block element a comprising flexible rod 1 is folded into two line pieces to create a leaf shape by using an elongated circle composed of the two line pieces. While the foregoing shape is maintained, fitting projections 21 projecting from opposite ends of each flexible rod 1 are fitted into fitting holes 3 on the plate-shaped base element 4. Accordingly, a new type of toy, having a leaf-shaped configuration, stands upright on base element 4. In addition, another flexible rod 1 is bent to exhibit a leaf-shaped contour, and fitting projections 21 projecting from opposite ends of the bent flexible rod 1 are fitted into fitting holes 3 on column-shaped element 8. Thereafter, an assembly of two flexible rods 1, consisting of flexible rod 1 including column-shaped element 8 and leaf-shaped flexible rod 1 is caused to stand upright on base element 4. As a result, a toy having a flower arrangement-shaped configuration can be built on base element 4.

FIGS. 5 and 6 illustrate a case where a movable object, similar to an automobile is built. In this case, four circular disc-shaped elements 6 are arranged on opposite sides of plate-shaped base element 4 (FIG. 5) and frame-shaped base element 5 (FIG. 6) so that the resultant toy exhibits an appearance similar to an automobile or a four-wheeled wagon. Subsequently, projections 21 projecting from opposite ends of block elements a each bent to exhibit a substantially inverted U-shaped contour are fitted into fitting holes 3 on base element 4, whereby a toy having a wagon-shaped configuration can be created.

In addition, a toy having a configuration different from the foregoing one can be created by disposing fitting projection 21, projecting from one end of a flexible rod 1, into fitting hole 3 of frame-shaped base element 5 and additionally fitting another projection 21 projecting from the other end of flexible rod 1 into fitting hole 3 on a spherical base element 7 so as to allow bent flexible rod 1 to stand on spherical base element 7.

When flexible rod 1 is bridged between one end of plate-shaped base element 4 and one end of the frame-shaped base element 5, the two objects are joined to each other to provide a toy having a trailer-type configuration.

Although not illustrated, block element a comprising flexible rod 1 can be used as a joint element.

In this case, another flexible rod 1 is wound around the intermediate part of an assembly of a plurality of flexible rods 1 bound together. Subsequently, opposite ends of the assembly are expanded in the radial direction to thereby create a new motif of toy configuration. To use the assembly as a joint, fitting projections 21 projecting from some of the bound flexible rods 1 are fitted into fitting holes 3 on other block elements b. Of course, many other configurations not illustrated or described may be accomplished by a child assembling the invention.

Next, advantageous effects derived from the toy of the present invention will be described below.

With respect to the toy of the present invention, flexible rod 1 is essentially composed of plastically deformable core 11 and soft sheath 12 surrounding core 11 while extending along the axis of the same. A desired toy is formed or built by combining block elements a each including fitting terminals 2 at one end, or opposite ends, of flexible rod 1 with block elements b each having fitting holes 3 to be fitted onto one of fitting projections 21 formed at predetermined positions on the surface of block elements a thereof. Thus, in contrast with the conventional toy constructions using only hard elements, the toy of the present invention can remarkably widen the scope of toy-configuration.

Also, since flexible rods 1 are combined with a part of each block element b, the resultant toy assembled or built by combination of block elements a with other block elements b exhibits a unique appearance. Thus, a significant feature of the toy of the present invention is the soft flexible feeling different from a hard feeling derived from a conventional toy.

Since each block element is constructed in an integral structure composed of flexible core 11 and soft sheath 12, core 11 is reliably protected by soft sheath 12. This minimizes the possibility that a part of core 11 will break and project outside of soft sheath 12 due to repeated bending or folding operations. Thus, another significant feature of the toy of the present invention is that any child can safely play with the toy of the present invention.

In a case where a shape memory alloy, a shape memory resin or a shape memory rubber is selectively employed as a raw material for core 11, the original shape can be restored merely by heating block element a after a child finishes playing. Thus, block elements a can be stored in an efficient manner while maintaining their initial shape.

While the present invention has been described above with respect to preferred embodiments thereof, it should of course be understood that the present invention should not be limited only to these embodiments, but various changes or modifications may be made without departure from the scope of the invention as defined by the appended claims.

What is claimed is:

1. A toy that can be assembled by a child independently, comprising:

at least one elongated flexible element having a substantially smooth outer surface;

a spherical fitting terminal having a plurality of projections integrally formed thereon, said fitting terminal also having a cylindrical protrusion integrally formed thereon;

an end portion of said flexible element being inserted and fixed into said cylindrical protrusion;

a block element having a plurality of fitting holes which are adapted to receive said projections.

2. A toy as claimed in claim 1 wherein said flexible element is composed of a deformable core arranged at the central part of said flexible element, while extending along the longitudinal axis thereof, and a flexible sheath molded of a soft synthetic resin surrounding the core, said sheath being attached to said core so as to form an integral structure.

3. A toy as claimed in claim 3, wherein said core is composed of an elongated material made of a raw material selected from one of a shape memory alloy and a shape memory synthetic resin.

4. A toy as claimed in claim 1, wherein said block element comprises a substantially flat base element on which a plurality of fitting holes are formed.

5. A toy as claimed in claim 1, wherein said block element comprises a cylindrical base element on which a plurality of fitting holes are formed.

6. A toy as claimed in claim 1, wherein said block element comprises a spherical base element on which a plurality of fitting holes are formed.

* * * * *